United States Patent [19]

Hirano

[11] Patent Number: 4,564,050

[45] Date of Patent: Jan. 14, 1986

[54] METHOD FOR STARTING THE OPERATION OF A LOOM

[75] Inventor: Hideo Hirano, Kariya, Japan

[73] Assignee: Kabushiki Kaisha Toyoda Jidoshokki Seisakusho, Aichi, Japan

[21] Appl. No.: 583,058

[22] Filed: Feb. 23, 1984

[30] Foreign Application Priority Data

Feb. 28, 1983 [JP] Japan ..... 58-31986

[51] Int. Cl.[4] ..... D03D 49/04

[52] U.S. Cl. ..... 139/97; 139/110; 139/109; 139/105

[58] Field of Search ..... 139/1 R, 97, 110, 105, 139/109, 114; 66/211

[56] References Cited

U.S. PATENT DOCUMENTS 3,125,127 3/1964 Locher ..... 139/97

4,480,665 11/1984 Imamora ..... 139/97

FOREIGN PATENT DOCUMENTS 629549 4/1982 Switzerland ..... 139/110

OTHER PUBLICATIONS

"Machine Design", May 14, 1981, vol. 53, No. 11, p. 276.

*Primary Examiner*—Henry S. Jaudon

*Assistant Examiner*—S. Shongut

*Attorney, Agent, or Firm*—Burgess, Ryan & Wayne

[57] ABSTRACT

A method for starting the operation of a loom always under a constant warp tension after the completion of the amendment of faults in the woven fabric such as miss-pick. A warp beam in the stationary loom is rotated by a commmand signal from a control unit in the normal or reverse direction so that the preset tension can be attained. As a result, a weaving bar which often occurs in the prior art just after the loom has restarted due to disturbance of gear ratio of the speed changer during the transient state can be avoided.

8 Claims, 6 Drawing Figures

M
10
C
11
9
Y
12
13
15
14
16
1
3
8
2
20
22
19
21
18

METHOD FOR STARTING THE OPERATION OF A LOOM

BACKGROUND OF THE INVENTION

1. Field of the Invention

The present invention relates to a method for starting the operation of a loom.

2. Description of the Prior Art

In a warp let off motion of a loom, in general, the tension of the warp is detected by a detector member such as tension roller or the like. The let off speed of a warp beam is increased when the tension becomes greater than a proper value and, conversely, it is decreased when the tension becomes smaller than the proper value so that the tension of the warp let off from the warp beam is maintained at a proper value. This speed control is carried out automatically by a speed changer connected to the warp beam. However, when the loom is rotated reversely, which is necessary for the correcting operation of miss-picking, the automatic control of the speed changer is disturbed and a weaving bar often occurs when the weaving operation is restarted after the miss picked weft has been removed. To avoid the occurrence of the weaving bar, the amendment of the disturbed condition of the speed change and/or the adjustment of a position of a cloth fell are necessary before restarting the weaving operation. These operation must be carried out manually and is very troublesome.

SUMMARY OF THE INVENTION

The present invention was accomplished by taking the above-mentioned fact into consideration, and its object is to provide a method for starting the operation of a loom under the condition in which the tension of the warp is brought into agreement with a preset value in order to prevent the occurrence of weaving bar when the loom is stopped or is reversely operated.

In order to achieve the above-mentioned object according to the present invention, a method for starting the operation of a loom from the stationary condition, comprising steps of:

a. presetting a first value $V_1$ in a control unit, which corresponds to first warp tension $T_1$ desirable for starting the loom operation, b. detecting tension of a warp let off from a warp beam, c. comparing the detected value V corresponding to the tension T to the preset value $V_1$ in the control unit, d. outputting, when the both value $V_1$ and V are different from each other, a command signal of rotating the warp beam in the normal or reverse direction until the both values $V_1$ and V coincide with each other to means for driving the warp beam independently from the remaining part of the loom, and e. starting the normal operation of the loom after the first warp tension $T_1$ has been attained as a result of the step d is provided.

Further, according to another aspect of the present invention, a method for starting the operation of a loom from the stationary condition, comprising steps of:

a. presetting, in a control unit, a first value $V_1$ corresponding to first warp tension $T_1$ desirable for starting the loom operation and a second value $V_2$ corresponding to second warp tension $T_2$ larger than the first warp tension, b. detecting tension T of a warp let off from a warp beam, c. comparing the detected value V corresponding to the tension T to the second value $V_2$ in the control unit, d. outputting, when the both values $V_2$ and V are different from each other, a command signal of rotating the warp beam in the normal or reverse direction until the both values $V_2$ and V coincide with each other to means for driving the warp beam independently from the remaining part of the loom, e. comparing the detected value V to the first value $V_1$ in the control unit, f. outputting, when the both values $V_1$ and V are different from each other, a command signal of rotating the warp beam in the normal or reverse direction until the both values $V_1$ and V coincide with each other to the means for driving the warp beam, and g. starting the normal operation of the loom after the first warp tension $T_1$ has been attained as a result of the step g is provided.

BRIEF DESCRIPTION OF THE DRAWINGS

These and other objects, features and advantages of the invention will become more apparent from the following detailed description by referring to the accompanying drawings in which.

DESCRIPTION OF THE PREFERRED EMBODIMENTS

To facilitate the understanding of the present invention, the prior art will be described more in detail by referring to FIG. 1.

Figure 1:
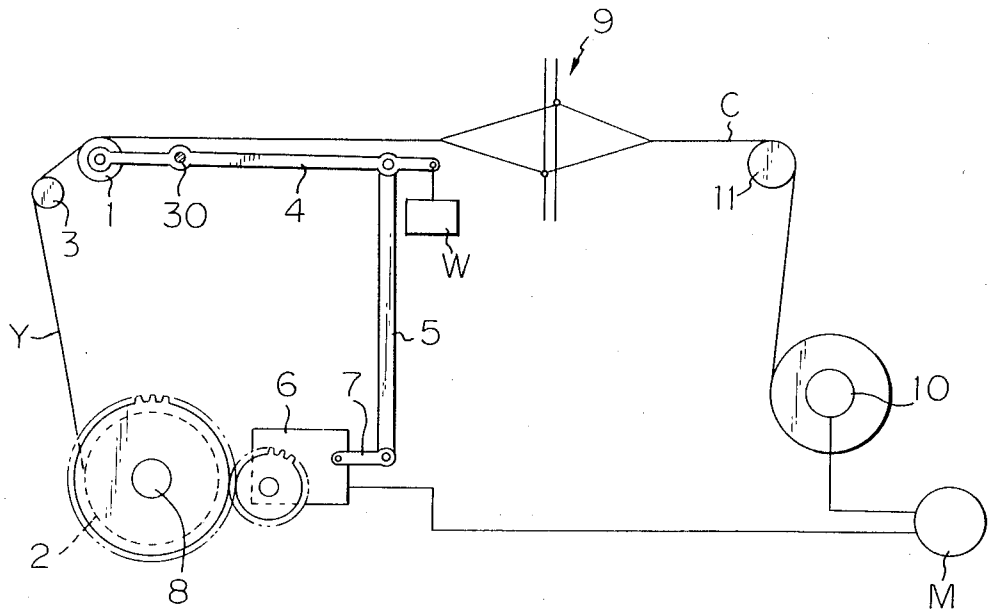
Fig. 1 PRIOR ART
FIG. 1 is a schematic side view illustrating a conventional warp let off motion.

FIG. 1 illustrates a prior art warp let off motion in which a tension roller 1 moves up and down responsive to the change in tension of a warp Y delivered from a warp beam 2 via a back roller 3. The up-down motion of the tension roller 1 is transmitted to a change lever 7 of a speed changer 6 via a tension lever 4 rotatably supported by a shaft 30 and a link 5. The rotation of a drive motor M for driving the loom is input to a warp beam shaft 8 at a reduced speed determined by a transmission ratio of the speed changer 6. Symbol W denotes a balance weight which imparts a predetermined tension to the warp Y. Symbol 9 denotes a shed yarn, and 10 denotes a cloth roller for taking up, at a constant speed, a woven fabric C guided by a guide roller 11. The cloth roller 11 is driven by the above-mentioned drive motor M.

In this warp let off motion, the tension roller 1 moves downwards to slightly pull up the change lever 7 when the tension of the warp Y becomes greater than the proper value, whereby the let off speed of the warp beam 2 increases. When the tension of the warp Y becomes smaller than the proper value, on the other hand, the tension roller 1 moves upwards to slightly push down the change lever 7, whereby the let off speed of the warp beam 2 decreases.

Here, in case of a miss-picking, i.e., when a weft could not be inserted properly between shedding, the weft must be removed to correct the fault in weaving. For this purpose, the loom is stopped and then is rotated reversely to ease the warp tension; i.e., the drive motor M is rotated in the reverse direction.

Due to the reverse rotation of the drive motor M, the cloth roller 10 rotates in reverse direction to ease the warp tension. The warp beam 2 is also necessary to rotate in reverse direction to avoid an excess slack of the warp tension. For this purpose, a reversible speed changer which can output a reduced rotation in the normal or reverse direction corresponding to the rotational direction of an input rotation, or a mechanism which can switch the normal and reverse rotation in a power transmission path between the speed changer and the warp beam 2 is preferably utilized.

However, this method also leaves the problem as described below. That is, in the warp let off motion having a reversible speed changer 6 which reversely rotates the warp beam 2 when the loom is operated in the reverse direction, the warp Y is delivered from the warp beam 2 at a speed faster than the speed of the woven fabric C which is wound on the cloth roller 10 and, hence, the warp Y tends to slack when the loom is operated in the normal direction. In this case, if the loom is operated in the reverse direction, the speed of the warp Y taken up by the warp beam 2 becomes greater than the speed of the woven fabric C delivered from the cloth roller 10, and the warp Y is tensioned contrary to the case of when the loom is operated in the normal direction.

This result is not favorable for the purpose of reduction of the warp tension. If the loom is operated further in the reverse direction, the transmission gear ratio is further deviated from a proper value for achieving an adequate warp tension.

Further, if the loom is rotated in the reverse direction under the condition in which the let off speed of the warp Y is smaller than the winding speed and, hence, the warp Y is being tensed, the speed of the warp Y taken up on the warp beam 2 becomes smaller than that of the woven fabric C delivered from the cloth roller 10, whereby the warp Y slacks. Then, the tension roller 1 moves upwards to lower the change lever 7, whereby the rotational speed of the warp beam 2 decreases. This result is not favorable for the purpose of increase of the warp tension. As the loom is further operated in the reverse direction, the transmission gear ratio is further deviated from a proper value for achieving an adequate warp tension.

Accordingly, when the loom is operated in the reverse direction in the case of miss-picking of the weft, the loom must be adjusted for the cloth fell of the woven fabric C prior to restarting the normal weaving operation and be adjusted for the transmission gear ratio of the speed changer 6, in order to prevent a weaving bar from occurring in the woven fabric C. This is a very cumbersome operation.

Not only limited to the abovesaid case of when the loom is reversely rotated, the warp also stretches naturally even when the loom is stationary for a rather longer time period for the purpose of machine checking, maintenance, adjustment and the like, resulting in change of the warp tension. This also causes the weaving bar.

Figure 2:
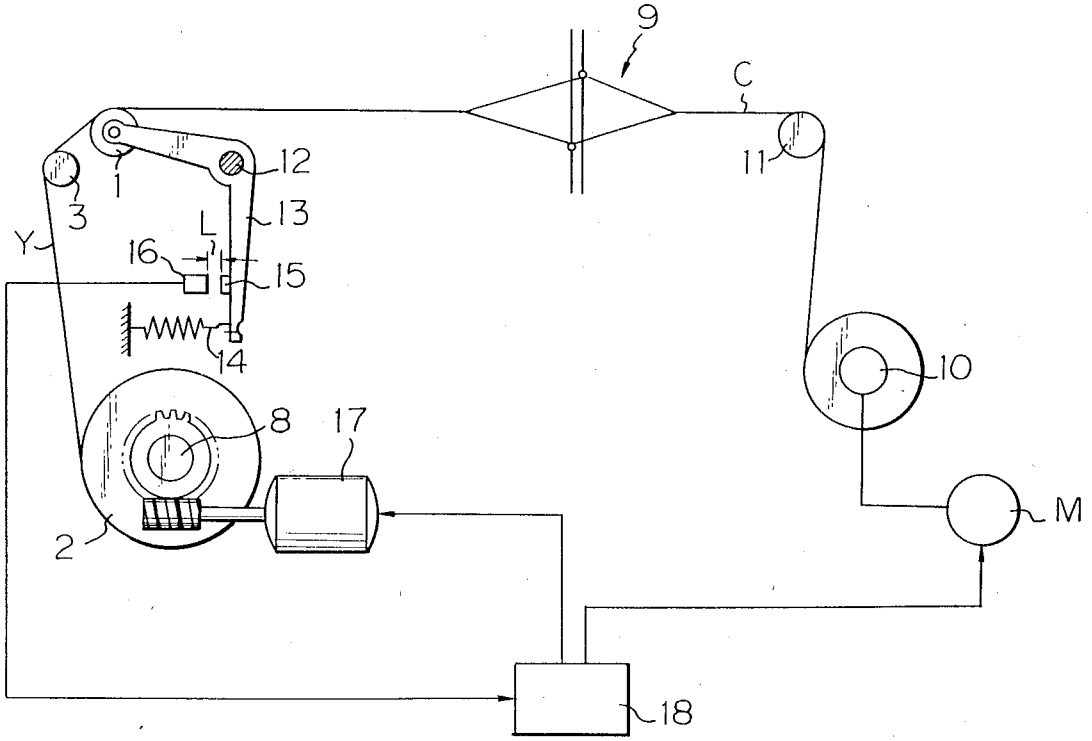
FIG. 2 is a schematic side view illustrating an embodiment of the present invention.
Figure 3:
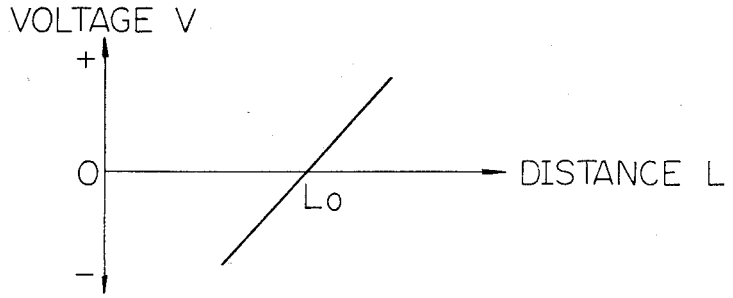
FIG. 3 is a graph which shows the state in which a displacement of the tension roller from the reference position is converted into a voltage value.

First Embodiment:

An embodiment of the invention will be described below with reference to FIGS. 2 to 4, in which the same portions as those of the above-mentioned conventional device shown in FIG. 1 are denoted by the same reference numerals and their detailed description is omitted.

A tension roller 1 is attached to an end of a detection lever 13 rotatably supported by a shaft 12. The detection lever 13 is biased to rotate in the clockwise direction in FIG. 2 about the shaft 12 by a spring 14 attached to the other end of the lever 13, so that the tension roller 1 is urged to come into contact with the warp Y.

A magnet 15 is fitted on the detection lever 13 at a portion near to the other end thereof, and a magnetic displacement sensor 16 is provided on a loom frame corresponding to the magnet 15. As the tension of the warp Y becomes large, the tension roller 1 is downwardly pressed, and the detection lever 13 swings in the counterclockwise direction in FIG. 2 about the shaft 12, so that the distance increases between the magnet 15 and the magnetic displacement sensor 16. As the tension of the warp Y becomes small, on the other hand, the tension roller 1 moves upwards, and the detection lever 13 swings in the clockwise direction in FIG. 2 about the shaft 12, and the distance decreases between the magnet 15 and the magnetic displacement sensor 16. The magnetic displacement sensor 16 outputs a signal voltage corresponding to the distance L. The signal is applied to a control unit 18 that will be mentioned later. A relationship between the distance L and the signal voltage V is shown in FIG. 3, in which a distance $L_0$ corresponding to a reference tension $T_0$ of the warp Y is transduced into zero voltage.

The warp beam 2 is rotated by a reversible beam drive motor 17 coupled to the warp beam shaft 8. The motor 17 is operated by the control unit 18 which generates a command signal responsive to the signal voltage from the magnetic displacement sensor 16. The control unit 18 also produces the command signal to the drive motor M.

The control unit 18 has a function described below.

Upon receipt of a "start" signal for a loom produced by manipulating a button or the like, the control unit 18 compares the signal voltage output from the magnetic displacement sensor 16 with a preset value $V_1$ ($>0$) that has been preset to the control unit 18 corresponding to a predetermined tension $T_1$ ($>T_0$). When the signal voltage corresponding to the tension of the warp Y has a value $A_1$ ($<0$) as shown in FIG. 4 under the condition in which the loom is stationary, the control unit 18 outputs a command signal of "reverse rotation" to the beam drive motor 17. As the motor 17 rotates in the reverse direction, the warp beam 2 rotates in a direction to take up the warp Y. Therefore, tension of the warp gradually exceeds the reference tension $T_0$ and approaches the preset tension $T_1$. As the tension of the warp Y comes into agreement with the preset tension $T_1$, a signal voltage $V_1$ denoted by $A_2$ in FIG. 4 is output from the magnetic displacement sensor 16 to the control unit 18 which then outputs a command signal of "stop" to the motor 17 responsive to the input signal voltage $V_1$. Thereafter, a command signal for "normal rotation" is output to the beam drive motor 17 and to the loom drive motor M. In this case, the beam drive motor 17 rotates in the normal direction. In this embodiment, the preset tension $T_1$ has been set to be greater than the reference tension $T_0$. When the operation of the loom is started, therefore, the control unit 18 normally rotates the beam drive motor 17 based upon the signal voltage from the magnetic displacement sensor 16, so that the tension of the warp Y comes into agreement with the reference tension $T_0$, i.e., so that the signal voltage $A_2$ in FIG. 4 approaches zero. While the loom is in operation, the control unit 18 controls the running speed of the beam drive motor 17 in accordance with the signal voltage from the magnetic displacement sensor 16, and controls the speed of the warp Y delivered from the warp beam 2, so that the tension thereof will come into agreement with the reference tension $T_0$.

Figure 4:
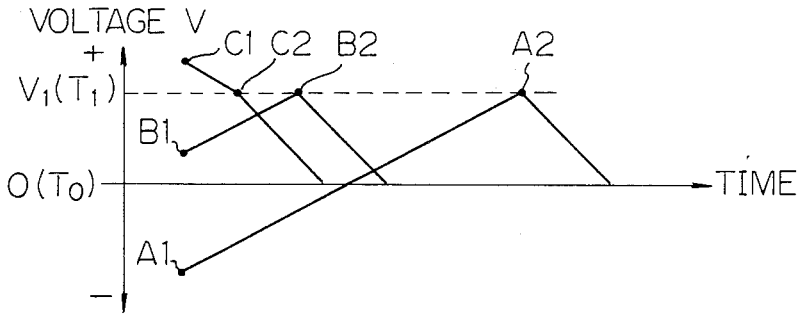
FIGS. 4 and 5 are graphs which show corrected state of the tension of warp in terms of a signal voltage.

If the signal voltage corresponding to the tension of the warp Y has a value of less than $V_1$ (>0) as denoted by $B_1$ in FIG. 4 when the loom is stationary, the control unit 18 upon receipt of a loom "start" signal, sends a command signal of "reverse rotation" to the beam drive motor 17, so that tension of the warp Y increases toward a direction to approach the preset tension $T_1$. As the tension of the warp Y comes into agreement with the preset tension $T_1$, the signal voltage $V_1$ denoted by $B_2$ in FIG. 4 is output to the control unit 18 so that it produces a command signal of "normal rotation". Thereafter, the motor 17 is controlled in the normal direction so that the tension of the warp Y comes into agreement with the reference tension $T_0$, i.e., so that the signal voltage $V_1$ denoted by $B_2$ in FIG. 4 approaches zero, in the same manner as described above.

If the signal voltage corresponding to the tension of the warp Y has a value of more than $V_1$ as denoted by $C_1$ in FIG. 4 when the loom is stationary, the control unit 18 upon receipt of a loom "start" signal, outputs a command signal of "normal rotation" to the beam drive motor 17. As the motor 17 rotates in the normal direction, the warp beam 2 rotates in a direction to deliver the warp Y; i.e., the tension of the warp Y decreases to approach the preset tension $T_1$. When the tension of the warp Y comes into agreement with the preset tension $T_1$, the signal voltage $V_1$ denoted by $C_2$ in FIG. 4 is output to the control unit 18. Therefore, the control unit 18 outputs a command signal of "stop" to the beam drive motor 17, and, at the same time, a command signal of "normal rotation" to the loom drive motor M. The control operation, thereafter, is carried out in the same manner as described above.

According to this embodiment, the preset tension $T_1$ at the time of starting the operation of the loom has been set to be greater than the reference tension $T_0$. Thus, a large tension is imparted to the warp Y only at the time of starting the normal operation of the loom, whereby the occurrence of weaving bar inherent to the conventional art is avoided.

According to the present invention, however, the preset tension at the time of starting the operation of the loom is not necessarily limited to a value greater than the reference tension $T_0$, but may, as required, be set to a value smaller than the reference tension $T_0$, or may be set to be in agreement with the reference tension $T_0$, depending upon the stopping phase of the loom or the weaving conditions. Usually, however, the preset tension is preferably brought into agreement with the reference tension $T_0$. If the preset tension is suitably changed at the time of starting the operation of the loom, the control unit 18 performs the control operation in the same manner as described above. Therefore, the tension of the warp can be maintained at the same level always when the operation is to be started, and weaving bar can be prevented from occurring.

In the embodiment described with reference to FIG. 4, the tension of the yarn Y is controlled to come into agreement with the preset tension $T_1$. Even if the tension roller 1 is located at a position corresponding to the preset tension $T_1$, however, the tension of the warp Y may not come into strict agreement with the preset tension $T_1$ due to frictional resistance of the shaft 12 and resistance of the yarn Y passing through dropper, heald or reed. Moreover, the resistance varies depending upon the rotational direction of the tension roller 1.

Figure 5:
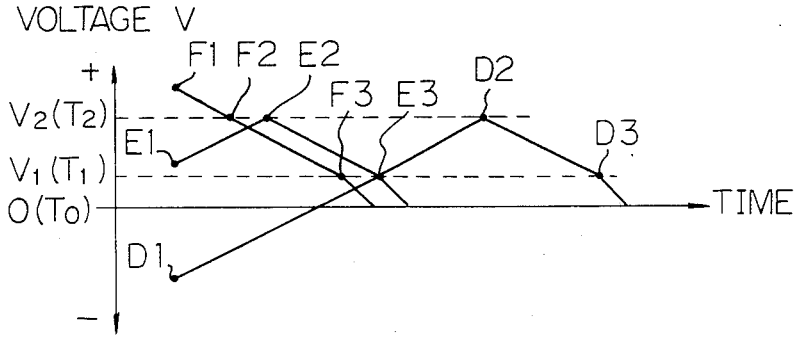

Means to solve this problem is described below by referring to FIGS. 3 and 5. According to this example, a preset tension $T_2$ having a value more than $T_1$ is newly provided in addition to the above-mentioned preset tension $T_1$. If the signal voltage $D_1$ corresponding to the tension of the warp Y has a value of less than $V_1$ as shown in FIG. 5 at the time when the loom is stationary, the control unit 18 upon receipt of a loom "start" signal, outputs a command signal of "reverse rotation" to the beam drive motor 17, so that the tension of the warp Y increases toward a direction to approach the preset tension $T_2$. As the tension of the warp Y comes into agreement with the preset tension $T_2$, a signal voltage $D_2$ having a value $V_2$ in FIG. 5 is output to the control unit 18. Then, the control unit 18 sends a command signal of "normal rotation" to the beam drive motor 17, so that the tension of the warp Y decreases toward a direction to approach the preset tension $T_1$. As the tension of the warp Y comes into agreement with the preset tension $T_1$, a signal voltage $D_3$ having a value $V_1$ in FIG. 5 is output to the control unit 18. Therefore, the control unit 18 works, first of all, to stop the beam drive motor 17, and then generates a command signal of "normal rotation" to the loom drive motor M. Thereafter, the beam drive motor 17 rotates in the normal direction, so that the tension of the warp Y comes into agreement with the reference tension $T_0$, i.e., the signal voltage $D_3$ in FIG. 5 approaches zero in the same manner as the aforementioned embodiment.

In the case that the signal voltage corresponding to the tension of the warp Y has a value $E_1$ having a value between $V_1$ and $V_2$ as shown in FIG. 5 at the time when the loom is stationary, the tension of the warp Y is once brought into agreement with the preset tension $T_2$ corresponding to the signal voltage $E_2$ and is then brought into agreement with the preset tension $T_1$ that corresponds to the signal voltage $E_1$ in FIG. 5. Under this condition, the operation of the loom is started.

In the case that the signal voltage corresponding to the tension of the warp Y has a value $F_1$ having a value of more than $V_2$ at the time when the loom is stationary, the control device 18 outputs a command signal of "normal rotation" to the beam drive motor 17, whereby the tension of the warp Y is once brought into agreement with the preset tension $T_2$ that corresponds to the signal voltage $F_2$ having a value $V_2$ and is then brought into agreement with the preset tension $T_1$ that corresponds to the signal voltage $F_3$ having a value $V_1$ in FIG. 5. Under this condition, operation of the loom is started.

That is, no matter how the tension of the warp Y may be under the condition in which the loom is stationary, the tension of the warp Y is brought into agreement with the preset tension $T_2$ and is then brought into agreement with the preset tension $T_1$. Operation of the loom is initiated under this condition. In other words, under the condition in which the loom is stationary, the tension roller 1 is first displaced from its initial position to the position corresponding to the preset tension $T_2$, and is then displaced to the position corresponding to the preset tension $T_1$. Namely, the tension roller 1 is displaced always in one direction to the position corresponding to the preset tension $T_1$. Thus, at the time of restarting the operation of the loom, the tension of the warp Y is brought into agreement with the preset tension $T_1$, thus eliminating the above-mentioned problem.

The preset tension $T_1$ can be brought into agreement with the reference tension $T_0$ as described above, or can be set to a value smaller than the reference tension $T_0$. Further, the preset tension $T_2$ can also be set to a value smaller than the reference tension $T_0$. The preset tensions $T_1$ and $T_2$ can be freely combined within this range.

Figure 6:
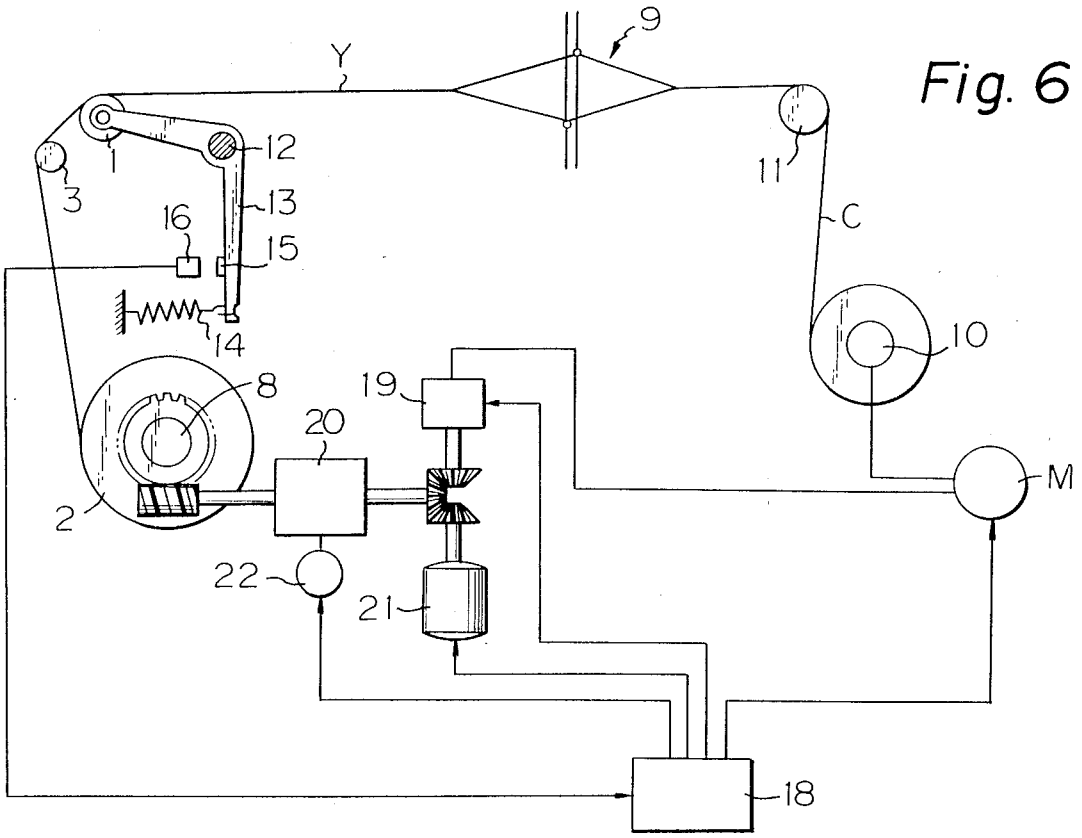
FIG. 6 is a schematic side view illustrating another embodiment of the present invention.

Second Embodiment:

A second embodiment of the present invention will be described below in connection with FIG. 6.

According to this embodiment, when the loom is in operation, the warp beam 2 gains the driving force from the drive motor M via an electromagnetic clutch 19 and a speed changer 20 and when the loom is stationary, the warp beam 2 gains the driving force for correcting the tension of warp from a correction motor 21 via the speed changer 20.

Upon receipt of a loom start signal, the control unit 18 generates a command signal of an "unlocking" command signal to the electromagnetic clutch 19, and sends a command signal of "normal" or "reverse rotation" to the correction motor 21 responsive to a signal voltage from the magnetic displacement sensor 16. Like the case of the above-mentioned first embodiment, when the tension of the warp Y comes into agreement with a preset value, the control unit 18 outputs a command signal of "stop" to the correction motor 21, that of "lock" to the electromagnetic clutch 19, and that of "normal rotation" to the drive motor M. As the normal operation of the loom is restarted, the control unit 18 outputs a "normal" or "reverse rotation" command signal to a pilot motor 22 having a function of adjusting the transmission gear ratio of the speed changer 20, depending upon the signal voltage corresponding to variation in tension of the warp Y.

In this embodiment, operation of the loom is started under the condition in which the tension of the warp Y is in agreement with the preset tension, and the occurrence of the weaving bar is eliminated in the same manner as in the above-mentioned first embodiment.

In the aforementioned first and second embodiments, the beam driver motor 17 or the correction motor 21 are started and stopped solely depending on the detected result of the warp tension. However, it is also possible to bring the tension of the warp Y into agreement with the preset tension by forecasting the timing for stopping the motor 17 based on the calculation of a time or a rotational angle required for completing the operation of the motor 17 by referring to the initial tension of the warp Y at the time of starting and the aimed preset tension.

In the above-mentioned two embodiments, furthermore, the operation of the loom is readily started by the command signal from the control unit 18 when the tension of the warp Y is brought into agreement with the preset tension $T_1$ which is suitable for initiation of the normal operation. It is, however, also possible to initiate the operation of the loom by suitably delaying the timing for starting. The command signal for starting the operation of the loom may be input by manipulating a button or the like after having confirmed that the tension of the warp Y is brought into agreement with the preset tension $T_1$ instead of a signal from the control unit 18.

Moreover, the reference tension $T_0$ may have a width corresponding to an allowable range of the warp tension.

Effects of the Invention

According to the present invention as described in detail in the foregoing, the tension of warp is detected prior to starting the operation of the loom, the warp beam is independently rotated in the forward direction or in the reverse direction depending on the detected result, and the operation of the loom is started under the condition in which the tension of warp is in agreement with a preset value. Thus, the operation can always be started under a constant warp tension, whereby the occurrence of the weaving bar can be avoided.

I claim:

1. A method for starting the operation of a loom from a stationary condition, comprising the steps of:

a. presetting a first value $V_1$ in a control unit, which corresponds to first wrap tension $T_1$ desirable for starting the loom operation, as well as a reference value O corresponding to a standard warp tension $T_0$ during normal weaving, b. detecting tension T of a warp let off from a warp beam, c. comparing the detected value V corresponding to the tension T to the preset value $V_1$ in the control unit, d. outputting, when both values $V_1$ and V are different from each other, a command signal for rotating the warp beam in the normal or reverse direction unitl both values $V_1$ and V coincide with each other, to means for driving the wrap beam independently from the remaining part of the loom, e. starting the operation of the loom after the first warp tension $T_1$ has been attained as a result of step d, and f. controlling the loom operation so that the standard warp tension $T_0$ is attained.

2. A method according to claim 1, in which the means for driving the warp beam is an exclusive motor provided separately from a main motor of the loom.

3. A method according to claim 1, in which the warp tension is detected by means of a detecting lever having a tension roller on one end and a magnet on the other end, and a magnetic displacement sensor facing the magnet.

4. A method for starting the operation of a loom from the stationary condition, comprising steps of:

a. presetting, in a control unit, a first value $V_1$ corresponding to first warp tension $T_1$ desirable for starting the loom operation and a second value $V_2$ corresponding to second warp tension $T_2$ larger than the first warp tension, b. detecting tension T of a warp let off from a warp beam, c. comparing the detected value V corresponding to the tension T to the second value $V_2$ in the control unit, d. outputting, when the both values $V_2$ and V are different from each other, a command signal of rotating the warp beam in the normal or reverse direction until the both values $V_2$ and V coincide with each other to means for driving the warp beam independently from the remaining part of the loom, e. comparing the detected value V to the first value $V_1$ in the control unit, f. outputting, when the both values $V_1$ and V are different from each other, a command signal of rotating the warp beam in the normal or reverse direction until the both values $V_1$ and V coincide with each other to the means for driving the warp beam, and g. starting the operation of the loom after the first warp tension $T_1$ has been attained as a result of the step f.

5. A method according to claim 1, in which the means for driving the warp beam is an exclusive motor provided separately from a main motor of the loom.

6. A method according to claim 5, in which the means for driving the wrap beam is a speed changer, an input side thereof being connected to a correction motor and to a main motor of the loom via a electro-magnetic clutch.

7. A method according to claim 5, in which the warp tension is detected by means of a detecting lever having a tension roller on one end and a magnet of the other end, and a magnetic displacement sensor facing the magnet.

8. A method for starting the operation of a loom from a stationary condition, comprising the steps of:

a. presetting a first value $V_1$ in a control unit, which corresponds to first warp tension $T_1$ desirable for starting the loom operation, b. detecting tension T of a warp let off from a warp beam, c. comparing the detected value V corresponding to the tension T to the preset value $V_1$ in the control unit, d. outputting, when both values $V_1$ and V are different from each other, a command signal for rotating the warp beam in the normal or reverse direction until both values $V_1$ and V coincide with each other to a speed changer for driving the warp beam independently from the remaining part of the loom, an input side of said speed changer being connected to a correction motor and to a main motor of the loom via an electro-magnetic clutch, and e. starting the operation of the loom after the first warp tension $T_1$ has been attained as a result of step d.

* * * * *